US006189696B1

(12) United States Patent
Tuerk et al.

(10) Patent No.: US 6,189,696 B1
(45) **Date of Patent: *Feb. 20, 2001**

(54) CONSUMER ARTICLE COMPRISING A WC BASKET UNIT AND RE-FILL BOTTLE

(75) Inventors: Erich Tuerk, Langenfeld; Georg Muehlhausen, Duesseldorf, both of (DE)

(73) Assignee: Henkel Kommanditgesellschaft auf Aktien, Duesseldorf (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/091,123

(22) PCT Filed: Dec. 5, 1996

(86) PCT No.: PCT/EP96/05445

§ 371 Date: Jul. 8, 1998

§ 102(e) Date: Jul. 8, 1998

(87) PCT Pub. No.: WO97/21882

PCT Pub. Date: Jun. 19, 1997

(30) Foreign Application Priority Data

Dec. 14, 1995 (DE) ..... 195 46 734

(51) Int. Cl.[7] ..... E03D 9/02

(52) U.S. Cl. ..... 206/576; 206/229; 206/581; 4/231

(58) Field of Search ..... 206/0.5, 229, 576, 206/577, 581; 4/231

(56) References Cited

FOREIGN PATENT DOCUMENTS

| | | |
|---|---|---|
| 29 09 449 | 9/1980 | (DE) . |
| 34 19 169 | 11/1985 | (DE) . |
| 38 04 666 | 7/1989 | (DE) . |
| 43 39 889 | 4/1995 | (DE) . |
| 195 20 145 | 12/1996 | (DE) . |
| 0 201 376 | 11/1986 | (EP) . |

*Primary Examiner*—Robert M. Fetsuga
(74) *Attorney, Agent, or Firm*—Wayne C. Jaeschke; Kenneth Watov; Glenn E. J. Murphy

(57) ABSTRACT

A packaging configuration includes a lavatory basket and a refill bottle assembly interconnected for storage, shipping and sale. The refill bottle assembly includes a refill bottle containing a cleaning agent for refilling the container of the lavatory basket during use, and a closure cap for sealing attachment with the outlet of the refill bottle. The lavatory basket includes a container for holding and selectively dispensing the cleaning agent, and a securing element extending therefrom. The container is configured to be releasably attached to a concave upper surface of the closure cap of the refill bottle by means of a projection tab on the closure cap in locking engagement with a corresponding recess in a wall of the container. A releasable connection is provided between the securing element and the refill bottle assembly to further secure the container to the refill bottle assembly.

16 Claims, 3 Drawing Sheets

CONSUMER ARTICLE COMPRISING A WC BASKET UNIT AND RE-FILL BOTTLE

BACKGROUND

1. Field of the Invention

This invention relates to a retail unit consisting of a lavatory basket and of a refill bottle with a closure cap intended for the lavatory basket.

2. Description of Related Art

It is known that lavatory bowls can be automatically cleaned by mounting active-substance formulations in a container on the inner rim of the lavatory bowl. Whenever the lavatory is flushed, part of the active substance in the container dissolves in the flushing water and is distributed in the bowl together with the water. In addition, some of the dissolved active substance remains in the siphon and performs a cleaning function there.

The lavatory basket of the retail unit mentioned at the beginning is designed for liquid or gel-like active-substance formulations. Particulars of this basket and its mode of operation can be found in German Patent Application 195 20 145.0. Reference is specifically made to the particulars mentioned in that patent application for the purposes of the disclosure. After the active-substance formulation accommodated in the basket has been used up, the basket can be refilled from a refill bottle through a special opening.

The container of the lavatory basket largely resembles a double cone in shape. The two cones are joined together by a hollow cylindrical middle part. A holding clip is arranged on this middle part for fixing the container to the rim of the toilet bowl.

A liquid to gel-like active-substance formulation is adapted to the refillable lavatory basket, providing for packaging the lavatory basket and the refill bottle together as a retail unit.

With similar retail units of a container and a refill bottle, it is known that the container can be modified accordingly so that it can be connected firmly, but releasably, to the bottle, for example by pushing onto the bottle, and thus forms a retail unit with the bottle. In addition, it is known that the container and the refill bottle can be connected by special connecting means, for example paper strips, adhesive strips or cords, etc. Another known possibility for combining the container and the refill bottle is based on a separate retail pack in which both parts are accommodated. Finally, it is also known that both parts, i.e. the refill bottle and the container, can be mounted on one and the same card.

However, for ecological reasons and to save costs, it is desirable to form a retail unit of the container and the refill bottle without having to use additional packaging material. It also desirable for the retail unit to have an attractive appearance. Finally, it should be possible to provide a retail unit without major modifications to the container in order not to affect the utility value of the lavatory basket by such modifications.

There are various known proposals for attaching dispensers or pouring aids. Thus, DE 29 09 449 A1 and DE 43 39 889 C1 to each depressions in the bottle wall with stop lugs and stop elements in the closure cover for a relatively small pouring tube.

However, this solution is unsuitable for relatively large accessories. In this case, for example for attaching dispensers for liquid detergents, it is known that the dispenser can be fitted onto the closure of a refill container. To this end, either a correspondingly large depression may be provided in the outer wall of the dispenser or individual tongues designed to bend elastically inwards can be provided around the opening of the dispenser (DE 38 04 666 C1) so that a securing connection with the closure cap is established.

However, these known connections entail fairly significant modifications to the shape and function of the accessory fitted onto the bottle and commensurate costs.

SUMMARY OF THE INVENTION

Accordingly, with the problems of the prior art in mind, an object of the present invention is to provide a compact visually attractive, and economic retail unit of the type mentioned at the beginning with no additional connecting means between the lavatory basket and the refill bottle.

According to one embodiment of the invention, the container rests on the upper side of the closure cap where it is releasably connected to the cap by means of a projection designed to engage in a corresponding recess, and in that a releasable securing connection is provided between the holder and the refill bottle, more particularly the closure cap.

In a preferred embodiment of the invention, the top portion of the closure cap is shaped oppositely to the wall of the container so that the container rests flush on the closure cap. On the one hand, a particularly stable connection is thus established between the container and the refill bottle and, on the other hand, the retail unit as a whole is given a visually attractive appearance.

The utility value of the lavatory basket is barely affected if the projection is provided on the closure cap and the corresponding recess is formed in the container wall.

Despite the projection on the top portion of the closure cap, when the bottle is placed upside down to facilitate emptying in the case of a gel-like activesubstance formulation remains the bottle extremely stable providing the projection does not protrude beyond those parts of the cap which extend the furthest upwards.

Particularly secure fixing of the lavatory basket to the refill bottle and a very compact retail unit are achieved by a groove in the side wall of the closure cap in which the holder at least partly engages. One or more stop lugs are advantageously provided on the inside of the groove for the releasable fixing of the holder.

BRIEF DESCRIPTION OF THE DRAWING

Various embodiments of the present invention are described in detail with reference to the following drawings, in which like items are identified by the same reference designation, wherein.

DETAILED DESCRIPTION OF THE INVENTION

Figure 1:
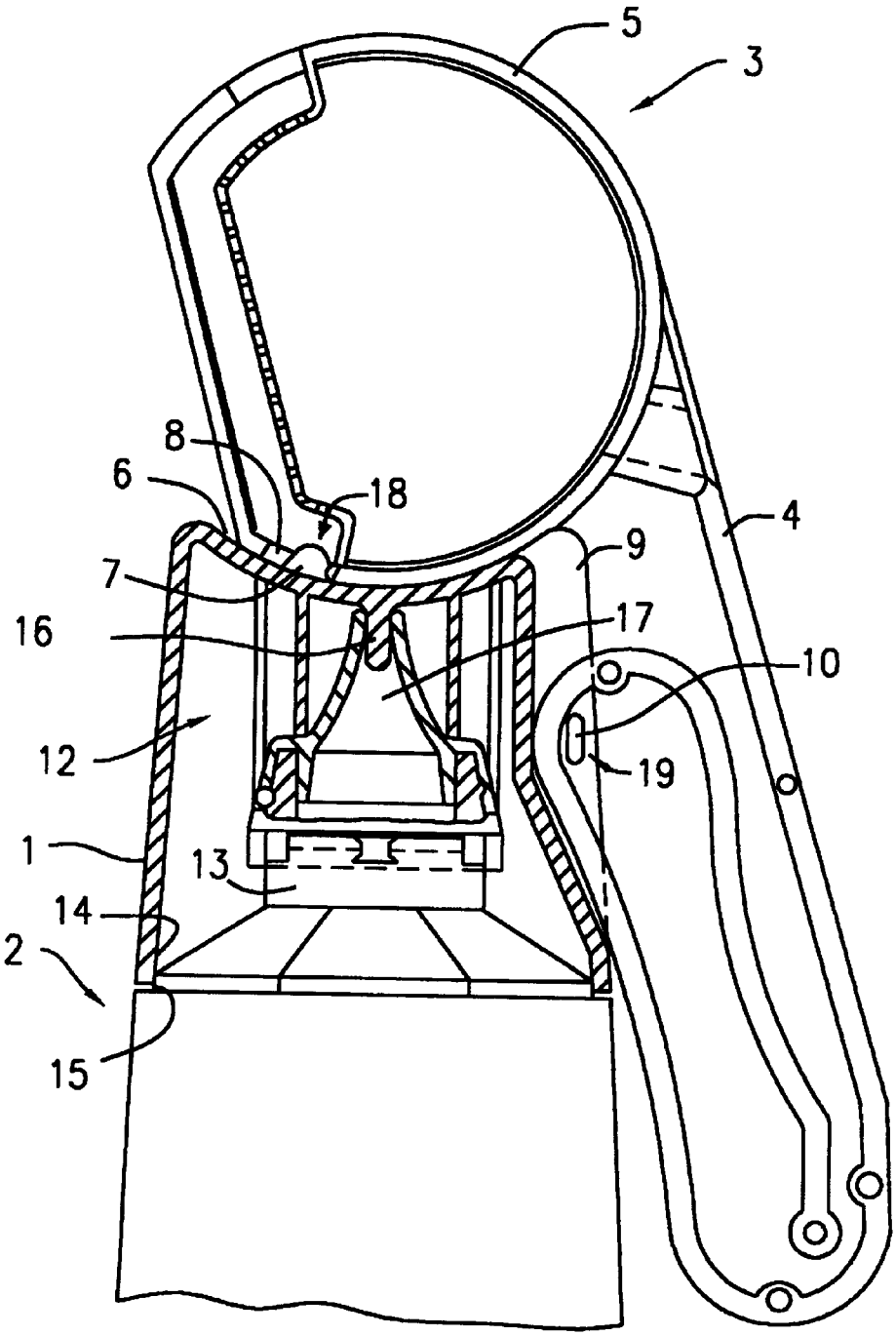
FIG. 1 is a section through the upper part of a retail unit according to the invention, i.e. a refill bottle surmounted by a lavatory basket.
Figure 2:
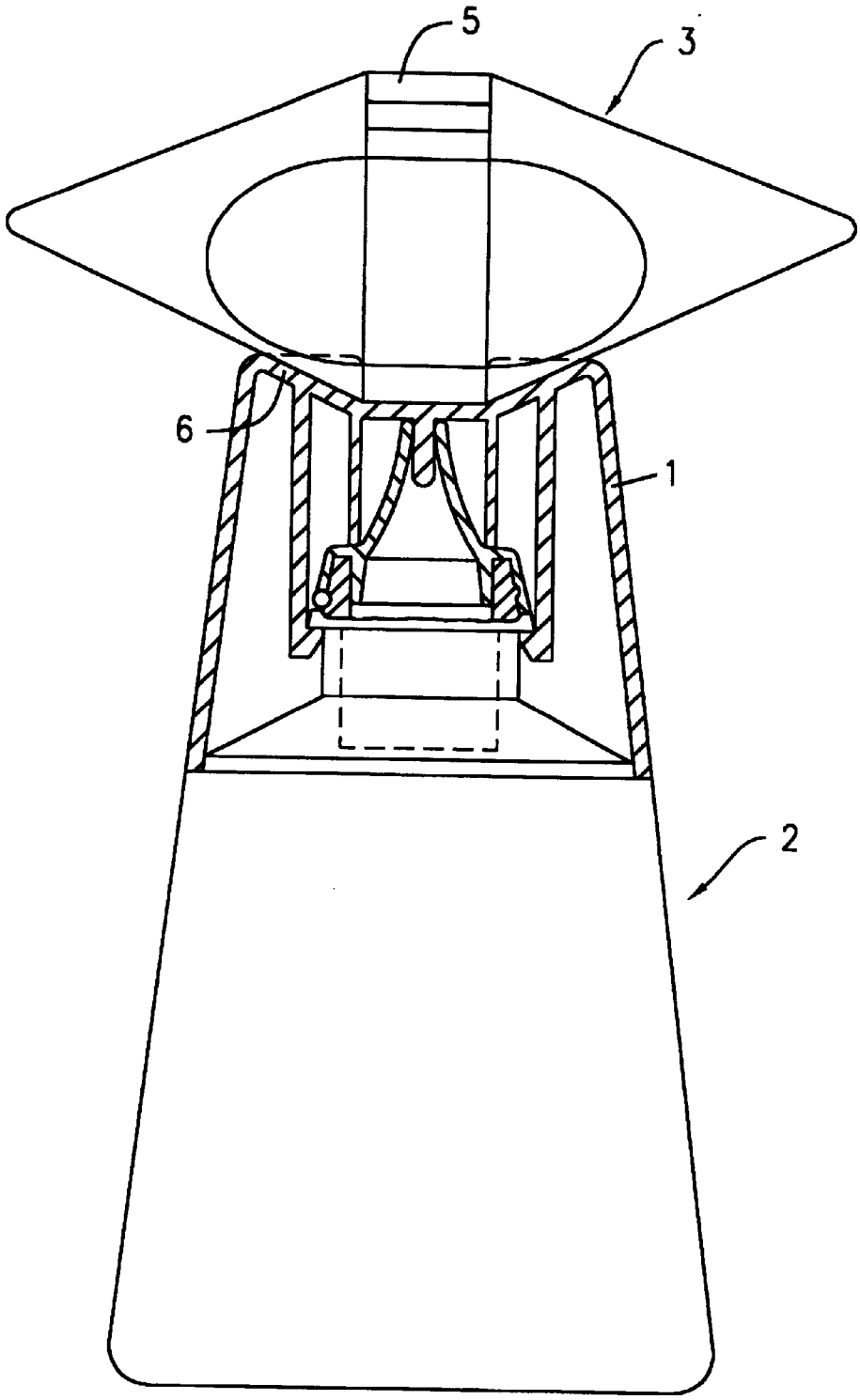
FIG. 2 is a side elevation, partly in section, looking perpendicularly of the viewing direction of FIG. 1.

As shown in FIG. 1, a lavatory basket consisting of a container 3 and a holder 4 is fitted onto the closure cap 1 of a refill bottle 2. More specifically, the closure cap 1 includes a bottom portion 12 which is adapted to securely fit onto a nozzle portion 13 of the refill bottle 2. The bottom portion 12 includes a peripheral skirt 14 adapted for being push fitted around a peripheral base surface 15 of the nozzle portion 13. Additionally, the bottom portion 12 also includes a centrally located plug member 16 configured for stopping and sealing an outlet 17 located at the end of the nozzle portion 13. The basket, which is in the form of a double cone with a cylindrical middle part 5 (see FIG. 2), rests flush with its middle part on the top portion 6 of the closure cap 1. This flush contact is achieved by the trough-like shape of the top portion 6 of the closure cap 1.

Figure 3:
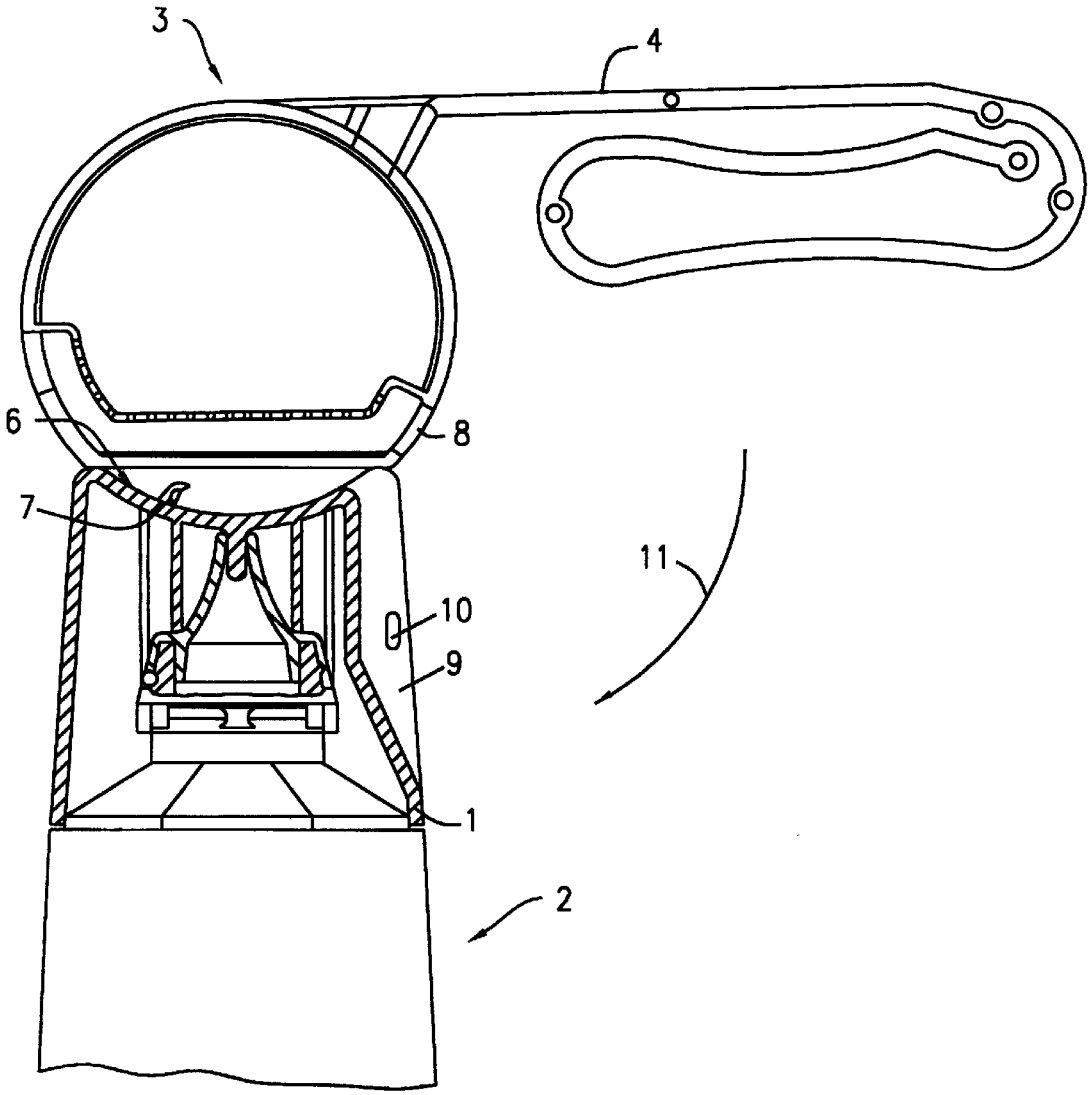
FIG. 3 is a view corresponding to FIG. 1 before engagement of the lavatory basket.

To prevent the container 3 from shifting on the top portion 6 of the closure cap, the container 3 and the closure cap 1, in combination, include a locking mechanism 18 for securing a connection therebetween. The locking mechanism 18 includes an elongate projection 7 that projects from the top portion 6 of the closure cap 1. The projection 7 engages in a corresponding recess 8 in the middle part 5 of the container 3. FIGS. 1 and 3 show the short side of the projection 7 which, for a scale of about 2:1, projects about 0.5 to 1 cm into the plane of the drawing. The recess 8 has a corresponding size.

In order further to safeguard the connection between the lavatory basket and the refill bottle, the container 3 and the closure cap 1, in combination, include a securement mechanism 19. The securement mechanism 19 includes a groove 9 formed in the side wall of the closure cap 1 and a stop lug 10 arranged on each side wall of the groove 9. Part of the holder 4 engages in the groove 9 and is held releasably but safely by the stop lugs 10 on the side walls of the groove 9. This is accomplished by latching a portion of the holder 4 onto the inner side of the stop lug 10. The latched part of the holder 4 is releasably fixed to the stop lugs 10 for secure engagement.

The container of the lavatory basket may be fitted onto the refill bottle as shown in FIG. 3. First, the container 3 is placed on the top portion 6 of the closure cap 1 with the holder 4 lying horizontally. Rotation about the longitudinal axis of the lavatory basket in the direction of the arrow 11 brings the middle part 5 and the holder 4 into the position shown in FIG. 1 in which the projection 7 engages in the recess 8 and the holder 4 engages in the stop lugs 10.

LIST OF REFERENCE NUMERALS

1 closure cap
2 refill bottle
3 container
4 holder
5 middle part
6 top portion
7 projection
8 recess
9 groove
10 stop lug
11 arrow

What is claimed is:

1. A packaging configuration comprising:

a container;

an elongated holder extending from and rigidly connected at one end to a sidewall portion thereof;

a cap member having a bottom portion, a side portion, and a top portion, said top portion being configured for receiving a mating portion of said container thereon;

a locking mechanism for removably securing said top portion of said cap member to said mating portion of said container;

a refill bottle containing a cleaning agent, said refill bottle further including an outlet therein;

said bottom portion of said cap member being configured for sealing attachment with the outlet of said refill bottle; and said container being moveable in one direction upon said cap member for operating said locking mechanism to securely attach the container to the top portion of said cap member during storage, shipping, and sale, whereby a portion of said elongated holder is removably attached to said cap member, whereafter for use, said container is moved in an opposite direction for disengaging said locking mechanism, and said holder is detached from said cap member, to permit removal of said container from the top portion of said cap member.

2. The packaging configuration of claim 1 herein said container is configured as a lavatory basket.

3. The packaging configuration of claim 1, further including:

said container having a substantially circular cross section; and said top portion of said cap member having a concave surface for flush mating contact with a convex portion of said container.

4. The packaging configuration of claim 3, wherein said locking mechanism includes:

a recess in the side wall portion of said container; and a projection tab extending from a surface on the upper side of said cap member, said projection tab being configured for reversible locking engagement with said recess.

5. The packaging configuration of claim 4, further including a securement mechanism for releasably securing locking engagement of said projection tab with the recess of said container.

6. The packaging configuration of claim 5 wherein said securement mechanism includes:

a groove being disposed in said side portion of said cap member; and a pair of stop lugs, each extending from an inside surface of said groove, said pair of stop lugs being configured for releasably securing a portion of the holder of said container.

7. A packaging configuration for permitting a lavatory basket to be removably attached to a refill bottle assembly containing a toilet cleaning agent, said packaging configuration comprising:

said lavatory basket including:

a container;

an elongated holder extending from said container; and a recess provided in a portion of a wall of said container; and said refill bottle assembly including:

a refill bottle;

a closure cap for sealing attachment with an outlet at the top of said bottle; and said closure cap further including a projection tab on a top surface, said top surface adapted for receiving a portion of said container, whereby said container can be moved in one direction upon said cap for locking said projection tab of said cap into said recess of said container during storage, shipping, and sale, whereby a portion of said elongated holder is removably attached to said closure cap whereafter for use, said container is moved in an opposite direction to disengage said projection tab from said recess, and said holder is detached from said closure cap to permit removal of said container from the closure cap of said refill bottle assembly.

8. The packaging configuration of claim 7, wherein said top surface of the closure cap is shaped to conform to a wall of the container so that the container rests flush on the closure cap.

9. The packaging configuration of claim 5, therein said container has a substantially circular cross section, and said top surface of said closure cap has a concave shape for receiving a convex portion of said container.

10. The packaging configuration of claim 9, further including a groove in a side wall portion of the closure cap.

11. The packaging configuration of claim 10, further including a pair of stop lugs, each extending from an inside side wall portion of the groove for releasably securing the holder.

12. The packaging configuration of claims 7, further including:

said container having a substantially circular cross section; and the top surface of said closure cap having a concave shape with the projection tab located therein.

13. The packaging configuration of claim 12, further including a groove in a side wall portion of the closure cap.

14. The packaging configuration of claim 13, further including a pair of stop lugs, each extending from an inside side wall portion of the groove whereby a portion of the holder is held releasably by the pair of stop lugs within the groove for releasably securing the holder.

15. A packaging configuration for permitting a lavatory basket to be removably attached to a refill bottle assembly containing a toilet cleaning agent, said packaging configuration comprising:

said lavatory basket including:

a container having a substantially circular cross section;

a holder extending from said container; and a recess provided in a portion of said container;

said refill bottle assembly including:

a refill bottle;

a closure cap for sealing attachment with the top of said bottle; and said closure cap further including a concave surface for receiving a convex wall portion of said container, a projection tab extending from said concave surface and being configured for releasable engagement with said recess, and a groove having a pair of stop lugs, each extending from an inside side wall portion thereof, said pair of stop lugs being configured for releasable engagement with said holder; and said container being positionable on said concave surface with said projection tab being releasably engaged with said recess, and said holder being releasably engaged with said pair of stop lugs in said groove, thereby securing said lavatory basket to said cap and its associated refill bottle.

16. A packaging configuration for permitting a lavatory basket to be removably attached to a refill bottle assembly containing a toilet cleaning agent, said packaging configuration comprising:

said lavatory basket including:

a container;

an elongated holder having an end attached to and extending from said container; and said refill bottle assembly including:

a refill bottle;

a closure cap for sealing attachment with an outlet at the top of said bottle; and said closure cap further including a groove in a side wall portion thereof, a pair of stop lugs, each extending from an inside wall portion of the groove for removably retaining a portion of said elongated holder, and a projection tab on a top surface, said top surface being adapted for receiving a convex portion of said container, whereby said container can be moved in one direction upon said cap for locking said projection tab of said cap into said recess of said container during storage, shipping, and sale, whereby a portion of said elongated holder is removably retained by said pair of stop lugs, whereafter for use, said container is moved in an opposite direction to disengage said projection tab from said recess and said holder is detached from said stop lugs to permit removal of said container from the closure cap of said refill bottle assembly.

* * * * *

UNITED STATES PATENT AND TRADEMARK OFFICE

CERTIFICATE OF CORRECTION

PATENT NO. : 6,189,696 B1
DATED : February 20, 2001
INVENTOR(S) : Tuerk et al.

It is certified that error appears in the above-identified patent and that said Letters Patent is hereby corrected as shown below:

Column 4,
Line 14, delete “herein”, and insert therefor -- wherein --.

Column 5,
Line 5, delete “claim 5, therein”, and insert therefor -- claim 8, wherein --.
Line 15, delete “claims”, and insert therefor -- claim --.
Line 25, after “groove”, insert -- , --.

Column 6,
Line 38, after “recess”, insert -- , --.
Line 39, after “lugs” insert -- , --.

Signed and Sealed this

Twenty-third Day of September, 2003

JAMES E. ROGAN
*Director of the United States Patent and Trademark Office*